United States Patent [19]

Hall

[11] 4,311,022

[45] Jan. 19, 1982

[54] FOLDABLE ICE PACK

[76] Inventor: John M. Hall, 7234 Bahn Blvd., Anderson, Calif. 96007

[21] Appl. No.: 141,628

[22] Filed: Apr. 18, 1980

[51] Int. Cl.[3] ..... F25D 3/08; F25D 3/10

[52] U.S. Cl. ..... 62/457; 62/372; 62/529; 62/530

[58] Field of Search ..... 62/430, 529, 530, 457, 62/372

[56] References Cited

U.S. PATENT DOCUMENTS

| | | | |
|---|---|---|---|
| 2,087,966 | 7/1937 | Clark | 62/530 X |
| 2,926,508 | 3/1960 | Moon | 62/529 X |
| 2,971,850 | 2/1961 | Barton | 62/530 |
| 3,262,283 | 7/1966 | Taylor | 62/372 |
| 3,854,156 | 12/1974 | Williams | 62/372 X |
| 4,183,226 | 1/1980 | Moore | 62/530 X |

FOREIGN PATENT DOCUMENTS

| | | | |
|---|---|---|---|
| 709145 | 5/1965 | Canada | 62/457 |
| 1401600 | 10/1968 | Fed. Rep. of Germany | 62/457 |
| 1018835 | 1/1953 | France | 62/530 |

*Primary Examiner*—Lloyd L. King
*Attorney, Agent, or Firm*—Jack C. Munro

[57] ABSTRACT

An ice pack which is constructed of a plurality of separate compartments which are connected together through a webbing assembly. Each of the compartments is movable in respect to each other permitting the ice pack to be located within confined various sizes of spaces. Within each compartment of the ice pack is located a quantity of freezable substance which is to be used as a refrigerant. Each compartment is enclosed by a wall assembly which retards the accumulation of moisture on the exterior surface of the wall assembly.

5 Claims, 3 Drawing Figures

FOLDABLE ICE PACK

BACKGROUND OF THE INVENTION

The field of this invention relates to a temporary refrigerant and more particularly to a reusable ice pack which when frozen can be placed in a lunch pail, ice chest or other type of portable carrying container with the ice pack functioning to maintain the contents located within the carrying container in a refrigerated state.

The use of an ice pack which contains a refrigerant is known. The typical refrigerant would be a plastic gelatin which is confined within a plastic sheet material wall. Such ice packs are to be frozen within a freezer and then can be removed therefrom and relocated within an ice chest or other similar carrying container in order to maintain food stuffs cold.

There are two disadvantages of ice packs of the prior art. Although the prior art ice packs are satisfactory for enlarged carrying containers, such as ice chests, such are not readily usable within smaller carrying containers, such as a lunch box. Additionally, prior art ice packs have a tendency to accumulate moisture on the exterior surface of the ice pack. This moisture is readily absorbed by any food stuffs which comes into contact with the ice pack. This is most undesirable since many types of food stuffs, such as sandwiches, are not readily palatable in a soggy condition.

SUMMARY OF THE INVENTION

The purpose of this invention is to construct a foldable ice pack which can be used as a temporary refrigerant which substantially eliminates the accumulation of moisture on its exterior surface during usage. This objective is achieved through the employing of a plurality of separate refrigerant containing compartments which are contained within a multiple layered wall assembly. Moisture is to accumulate between the layers of material thereby not accumulating on the exterior surface of the outer layer of material. The outer layer of material is to comprise a loose bag within which the compartmentalized ice pack is contained. The outer layer of material is to include a drain opening to facilitate drainage of any accumulated moisture. Also, an access opening is provided within the outer layer to provide for removal for cleaning of the outer layer of material.

Another purpose of this invention is to design an ice pack of a plurality of separate interconnected compartments which can be folded into a wide variety of different shapes permitting the ice pack to be used within confined containers of limited size, such as lunch boxes, small ice chests and the like.

DETAILED DESCRIPTION OF THE SHOWN EMBODIMENT

Figure 1:
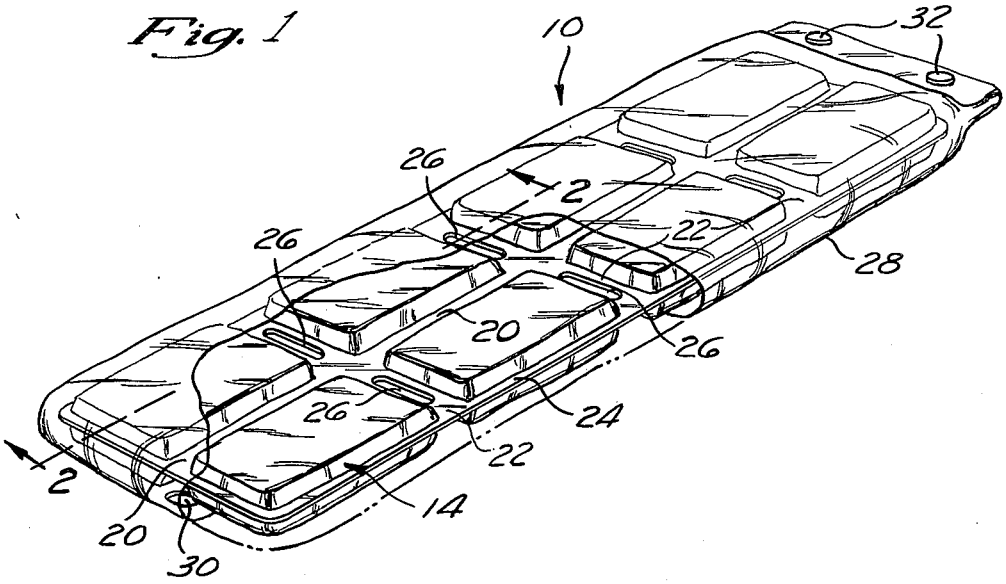
FIG. 1 is an isometric view of a foldable ice pack of this invention.
Figure 2:
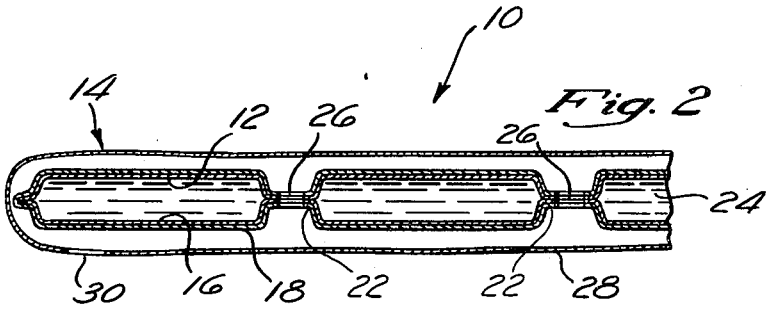
FIG. 2 is a cross-sectional view taken along line 2—2 of FIG. 1.

Referring particularly to the drawing, there is shown the foldable ice pack assembly 10 of this invention which is constructed generally of a plurality of compartments 12 which are formed by a wall assembly 14.

Figure 3:
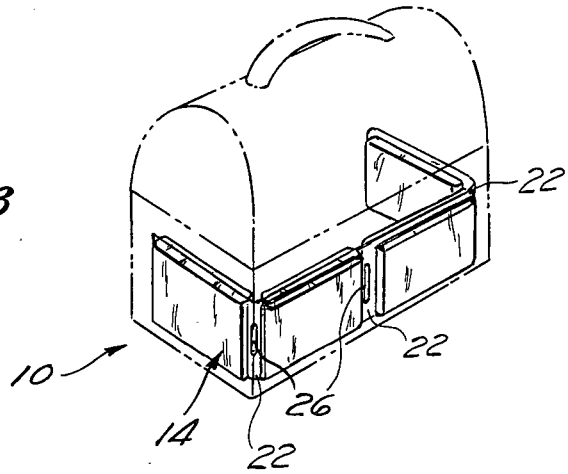
FIG. 3 is a diagramatic view of the foldable ice pack of this invention showing how such can be located within a confined small size carrying container, such as a lunch box.

The wall assembly 14 is constructed of a plurality of separate layers of plastic sheet material with there being an inner layer 16, an outer layer 18 and an additional outer layer 20. The inner layer 16 defines the side wall of each compartment 12. The inner layer 16 is sealed as by heat sealing between adjacent compartments 12 to form a longitudinal webbing strip 20 and a plurality of spaced apart transverse webbing strips 22. The webbing strips 20 may be cut by means of a cutting tool such as a knife or scissors so as to separate the ice pack assembly 10 into separate ice packs. This may be desirable so that a single in-line section of the compartments 12 may be employed within a confined space, such as the lunch box shown within FIG. 3. If the ice pack assembly 10 is to be employed within an ice chest, (not shown) cutting of the longitudinal strip 20 may not be required.

The outer layer is located about the inner layer 16 in a close fitting manner. This outer layer 18 is also heat sealed in the same manner as the inner layer 16 and in the same locations. There is inherently a slight air space located between the layers 16 and 18.

Within each compartment 12 is located a quantity of a refrigerant 24 which will normally take the form of a plastic gel. During the warming process, there is a natural tendency for moisture to accumulate on the exterior surface of the inner layer 16. This accumulated moisture will be confined to the slight air space between the layers 16 and 18.

Formed within the transverse webs 22 are openings 26. The openings 26 are provided for ease of movement of one compartment 12 with respect ot another compartment 12. This is so as to permit ease of folding of the ice pack assembly 10 into various configurations, such as the configuration shown within FIG. 3. Although each transverse web 22 will be initially very cold, this offers only a minimum amount of resistance to the folding of the ice pack assembly 10.

There is also the possibility that some moisture may collect on the exterior surface of the layer 18. To prevent this moisture from contaminating adjacent food stuffs, an additional layer of material in the form of a bag 28 is to be located in a loose fitting manner about the compartments 12. The bag 28 will normally be constructed of a transparent material and will be formed of sheet plastic.

One end of the bag 28 includes a drain hole 30 which is to provide for discharge of any accumulated moisture. Also, the bag 28 has an enlarged access opening which is closable by means of snaps 32 which permits removal of the compartmentalized ice pack assembly 10 in order to facilitate cleaning.

What is claimed is:

1. A foldable ice pack comprising:

a plurality of separate compartments, each said compartment to contain a refrigerant;

a webbing assembly innerconnecting said compartments, said webbing assembly including a single thin webbing strip located between each connected pair of said compartments;

each said compartment being enclosed by a wall assembly, said wall assembly comprising an inner layer of sheet material which is overlapped with an outer layer of sheet material, a slight air space is formed between said inner layer and said outer layer, said air space is to function as insulation retarding the accumulation of moisture on the exterior surface of said outer layer;

an additional layer of sheet material located about said outer layer, a second air space formed between said additional layer and said outer layer, said second air space to function as insulation further retarding the accumulation of moisture on the exterior surface of said additional layer; and a drain opening formed within said additional layer, whereby any moisture accumulated within said second air space to be discharged to the ambient through said drain opening.

2. The foldable ice pack as defined in claim 1 wherein:

an access opening provided within said additional layer, said compartments and said webbing assembly being removable intact through said access opening.

3. The foldable ice pack as defined in claim 2 wherein:

said compartments being connected together in an in-line manner.

4. The foldable ice pack as defined in claim 3 wherein:

said refrigerant takes the form of a gel.

5. The foldable ice pack as defined in claim 4 wherein:

At least one opening located within each of said webbing strips to facilitate said movement of said compartments in respect to each other.

* * * * *